United States Patent [19]

Nixon

[11] 4,387,322

[45] Jun. 7, 1983

[54] DISPLAY ARRANGEMENTS

[75] Inventor: Ralph D. Nixon, Braintree, England

[73] Assignee: English Electric Valve Company Limited, Chelmsford, England

[21] Appl. No.: 185,382

[22] Filed: Sep. 8, 1980

[30] Foreign Application Priority Data

Sep. 6, 1979 [GB] United Kingdom ..... 7930936

[51] Int. Cl.[3] ..... H01J 1/92; H01J 63/06

[52] U.S. Cl. ..... 313/497

[58] Field of Search ..... 313/495, 496, 497

[56] References Cited

U.S. PATENT DOCUMENTS

| | | | |
|---|---|---|---|
| 2,926,286 | 2/1960 | Skellett | 313/495 X |
| 2,927,237 | 3/1960 | Lieb | 313/495 |
| 3,836,806 | 9/1974 | Kobayakawa et al. | 313/497 |
| 3,942,065 | 3/1976 | Russ | 313/500 |
| 4,047,075 | 9/1977 | Schoberl | 313/500 |
| 4,211,586 | 7/1980 | Fang et al. | 313/500 X |
| 4,223,244 | 9/1980 | Kishino et al. | 313/497 |

FOREIGN PATENT DOCUMENTS

| | | |
|---|---|---|
| 543499 | 2/1942 | United Kingdom . |
| 908524 | 10/1962 | United Kingdom . |
| 1166598 | 10/1969 | United Kingdom . |
| 1433390 | 4/1976 | United Kingdom . |
| 1523947 | 9/1978 | United Kingdom . |
| 2031220 | 4/1980 | United Kingdom . |

*Primary Examiner*—Palmer C. Demeo

*Attorney, Agent, or Firm*—Spencer & Kaye

[57] ABSTRACT

A display arrangement is provided in the form of an elongate evacuated envelope (1) having a phosphor screen (11) which is capable of providing a very bright display. A number of mesh electrodes (6) are positioned side by side along the length of the envelope so as to selectively determine which portions of the phosphor screen emit light. By controlling the potential of the mesh electrodes, the display can be switched on and off rapidly to provide a versatile form of information display. A large number of evacuated envelopes can be assembled to form a two dimensional array and if desired a color display can be provided by using phosphor patched of different colors.

6 Claims, 4 Drawing Figures

FIG. 1a
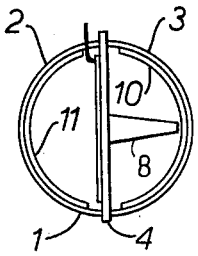
FIG. 1b
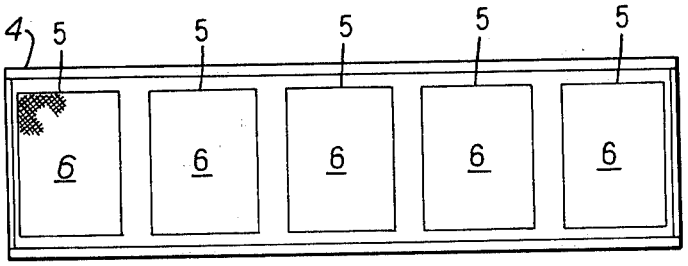
FIG. 1c
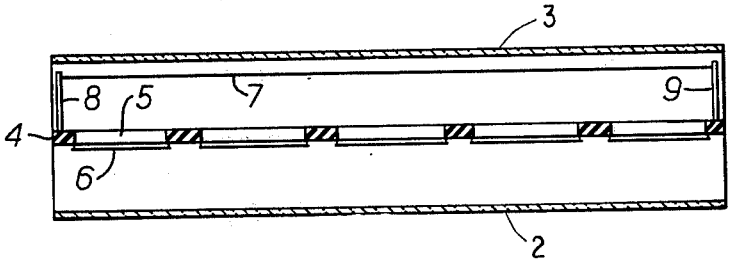
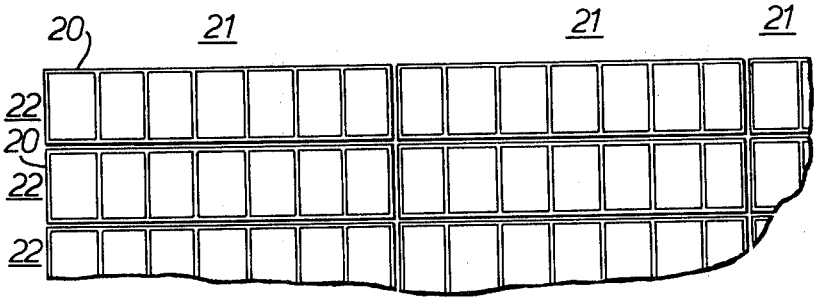
FIG. 2

DISPLAY ARRANGEMENTS

BACKGROUND OF THE INVENTION

This invention relates to display arrangements and in particular is concerned with display arrangements which include a visual display device, which is capable of producing a bright display. The need can arise for a large visual display in which the information displayed can be altered rapidly and in a versatile manner.

SUMMARY OF THE INVENTION

According to this invention, a display arrangement includes a visible device which comprises an elongate evacuated envelope with an electron emissive filament extending from one end of the envelope to the other end and being arranged to irradiate with electrons a fluorescent screen which also extends from one end of the envelope to the other end; and a plurality of separately addressable mesh electrodes positioned side by side along the length of the envelope so as to control the passage of electrons from the filament to selected regions of the fluorescent screen.

Preferably the mesh electrodes are mounted on a common apertured plate with the electrodes being aligned with respective apertures. Each mesh electrode must be electrically insulated from the other mesh electrodes, and this can be achieved by mounting them on an electrically insulating plate, or alternatively they can be mounted on to a metallic plate by means of an electrically insulating adhesive or cement.

Preferably the portion of the envelope which carries the screen has an outer surface which is convex.

Preferably again it forms part of a cylindrical surface.

Conveniently the envelope consists of two hemicylinders which are located on opposite sides of the plate which supports said mesh electrodes. Since the envelope must contain a high vacuum the hemicylinders must be hermetically sealed to the plate.

Preferably the filament is supported under tension by arms which project from the surface of said plate which is remote from said screen.

Preferably that hemicylinder which is adjacent to said filament is provided with an internal electrically conductive coating. In operation, this coating acts as an electrode which influences the trajectories of the electrons as they are emitted by the filament.

The fluorescent screen may consist of phosphor material, which shows a single colour or white light when it is irradiated by high energy electrons. Alternatively, it may consist of a repetitive sequence of phosphor patches which emit different colours respectively. By choosing a sequence of three primary colours, a colour display can be produced by selectively switching those mesh electrodes which control passage of electrons to the phosphor which emits the appropriately coloured light.

A number of these display devices can be assembled to form a large display arrangement. Preferably a display arrangement comprises a plurality of rows and columns of display elements, each element corresponding to an individual separately addressable mesh electrode, with each row comprising a plurality of display devices mounted end to end.

BRIEF DESCRIPTION OF THE DRAWINGS

The invention is further described by way of example with reference to the accompanying drawings in which, FIGS. 1(*a*)–1(*c*) show three views of a display device in accordance with the present invention; and FIG. 2 shows part of a large display arrangement consisting of a number of individual display devices.

DESCRIPTION OF THE PREFERRED EMBODIMENTS

Referring to FIG. 1, a display device consists of an evacuated glass envelope 1 in the form of two hemicylindrical portions 2 and 3. These two portions are sealed to opposite surfaces of a metallic support plate 4, and the envelope so formed has a uniform cross-sectional area along its length. The seal is made by means of a cement or adhesive which is capable of forming a vacuum tight joint. The plate 4 is provided with five apertures 5 (the position of these is best seen in FIG. 1*c*). Mesh electrodes 6 are mounted across each of these apertures 5 and they are mounted so as to be electrically insulated from the plate 4. Conveniently they could be mounted by means of a glass cement material such as pyroceram. Each aperture is rectangular in shape and conforms approximately to the rectangular shape of each mesh electrode, the shape of which can be seen in FIG. 1*b*. A wire filament 7 is held under tension between a pair of arms 8 and 9 which project from one surface of the support plate 4. The filament 7 constitutes a directly heated cathode and is formed of an oxide coated material from which electrons are emitted in large quantities when the filament is heated by passing an electric current through it. The filament 7 is located within the hemicylinder 3 and the inner surface of this is provided with a conductive coating 10, which acts as an electrode when the display is being used. The inner surface of the other hemicylinder 2 is provided with a layer of phosphor material 11. Additionally, this surface is provided with a transparent electrically conductive coating or is covered on its inner surface with a thin continuous layer of evaporated aluminium which acts as an anode. Leads are provided to the anode, the coating 10, the filament 7 and each of the mesh electrodes 6, so that electrical potentials can be applied to them as required from outside the evacuated envelope 1.

In operation, a potential of about 5 kV is applied to the anode, and a potential of about +5 volts (with respect to cathode potential) is applied to the coating 10. Although a very small potential difference will exist between the ends of the filament 7, for practical purposes it may be regarded as being at a single cathode potential. Alternatively the filament 7 may be energised by a short unidirectional pulse (as disclosed in our copending application number 39285/78) and the operating circuit so arranged that emission current is only drawn from the filament when no heating voltage is present across it. When each mesh electrode is held at cathode potential no electrons will pass through it and consequently none will reach the phosphor 11. However, when a low positive potential, typically +10 volts with respect to cathode potential, is applied to a mesh electrode 6, electrons from the filament 7 will pass through and be rapidly accelerated under the action of the high anode potential. This causes the electrons to strike the phosphor material with high energy and a very large proportion of the electron energy is converted into visible light, the colour of which is dependent on the nature of the phosphor. Thus by controlling the potential of each mesh electrode 6, the five corresponding display elements can rapidly be switched on and off as required in any combination.

It is found that the small positive potential on the mesh 10 enables a more uniform illumination of the phosphor 11 to be obtained. It is believed that a space charge region is formed between the filament 7 and the mesh electrodes 6 from which electrons can be drawn under the action of the anode potential when the potential on the mesh electrodes is correct.

Although in FIG. 1, only five mesh electrodes are shown, it is possible to increase this number to provide a correspondingly larger number of individual display elements. Additionally, it is not necessary to provide a single continuous layer of phosphor material 11 which extends the entire length of the envelope 1. Instead, contiguous regions of phosphor of different colours can be provided so that different picture elements will exhibit different colours. By selectively controlling the appropriate mesh electrode a coloured display can be produced. In order to produce a true colour display a repetitive sequence of three primary colours or an appropriately proportioned simultaneous energisation should be provided.

By assembling a large number of these display devices to form a large composite display arrangement, a two dimensional display surface can be formed. Part of such a display arrangement is illustrated in FIG. 2 in which a number of seven element display devices 20 are assembled together in columns 21 and rows 22. The spacing between the individual display elements of a given display device 20 should be so arranged that no discontinuity or irregularity in the spacing occurs between the last display element of one device and the first display element of the next device. This can be achieved by positioning the end display elements of a display device very close indeed to the ends of the evacuated envelopes. Each row 22 consists of a number of individual display devices 20 arranged end to end. In FIG. 2, it is intended that only a single colour will be displayed—typically white light will be emitted by the phosphor material. However, a large two dimensional colour display can be produced by using a repetitive sequence of phosphor patches of three different primary colours. In this case it would be convenient to make the number of individual display elements in a display device a multiple of three.

By assembling as many display devices as are necessary, a very large display arrangement can readily be produced in an economic and convenient manner. Each display element is separately controllable by means of the appropriate potential applied to its mesh electrode. By accessing these in sequence, the display arrangement can be scanned in the manner of a television screen in a raster pattern. This, however, is not essential and a very bright display can be achieved, since it is possible for each display element to be continuously illuminated. Because the efficiency of a phosphor in converting electron energy into visible light is very high, the overall efficiency of such a display arrangement can be very good, with heat losses being kept to a minimum. The rapid switching speed which can be obtained by controlling the passage of electrons through the individual mesh electrodes is very high, and is very much greater than could be achieved by switching on and off individual conventional incandescent lamps.

I claim:

1. A display arrangement including at least one display device, said at least one display device comprising:

an elongated plate provided with a plurality of apertures disposed side by side along the length of said plate;

a plurality of separately addressable mesh electrodes each aligned with a respective one of said apertures and supported by said plate;

two elongated hemicylinders each attached to a respective side of said plate, said two hemicylinders forming an elongated evacuated envelope having first and second ends;

a fluorescent screen disposed on an inner surface of one of said hemicylinders and extending from said first end to said second end of said envelope, at least said one hemicylinder, on which said fluorescent screen is disposed, being light transmitting; and an electron emissive filament disposed on the side of said plate remote from said hemicylinder on which said fluorescent screen is disposed and extending from said first end to said second end of said envelope;

wherein said mesh electrodes control the passage of electrons from said filament to selected regions of said fluorescent screen.

2. An arrangement as claimed in claim 1 and wherein said apertured plate is metallic and each mesh electrode is mounted on it by means of an electrically insulating adhesive or cement.

3. An arrangement as claimed in claim 2 and wherein the filament is supported under tension by arms which project from the surface of said plate which is remote from said screen.

4. An arrangement as claimed in claim 3 and wherein that hemicylinder which is adjacent to said filament is provided with an internal electrically conducting coating.

5. An arrangement as claimed in claim 1 and wherein a plurality of said display devices are assembled together to provide a large display surface.

6. An arrangement as claimed in claim 5 and further comprising a plurality of rows and columns of display elements, each said element corresponding to an individual separately addressable mesh electrode, with each row comprising a plurality of display devices mounted end to end.

* * * * *